US005505873A

United States Patent [19]

Akabane et al.

[11] Patent Number: 5,505,873

[45] Date of Patent: Apr. 9, 1996

[54] PEROXIDE BLEACHING COMPOSITIONS CONTAINING QUANTERNARY AMMONIUM PHTHALATE ESTER BLEACH ACTIVATORS FOR HOUSE CLEANING

[75] Inventors: Yasuhiro Akabane, Soka; Sonoko Shintani, Tokyo; Junji Ono, Kodaira; Takao Osugi, Iwatsuki; Naoki Mizushima, Kamakura; Shin-ichi Suzuki, Odawara, all of Japan

[73] Assignee: Lion Corporation, Tokyo, Japan

[21] Appl. No.: 386,055

[22] Filed: Feb. 7, 1995

[30] Foreign Application Priority Data

Dec. 14, 1994 [JP] Japan ..... 6-017625

[51] Int. Cl.[6] ..... C11D 3/30; C11D 3/39; C11D 3/395; C11D 7/54

[52] U.S. Cl. ..... 252/102; 134/2; 252/103; 252/104; 252/173; 252/186.38; 252/547; 252/DIG. 14; 560/88

[58] Field of Search ..... 134/2; 252/102, 252/103, 104, 173, 186.38, 547, DIG. 14; 560/88

[56] References Cited

U.S. PATENT DOCUMENTS

| | | | |
|---|---|---|---|
| 3,494,787 | 2/1970 | Lund | 252/95 |
| 3,996,152 | 12/1976 | Edwards | 252/95 |
| 4,011,169 | 3/1977 | Diehl | 252/95 |
| 4,100,095 | 7/1978 | Hutchins | 252/99 |
| 4,110,074 | 8/1978 | Finley | 8/111 |
| 4,397,757 | 8/1983 | Bright | 252/186.41 |
| 4,421,664 | 12/1983 | Anderson | 252/94 |
| 4,427,566 | 1/1984 | Clements | 252/102 |
| 4,444,674 | 4/1984 | Gray | 252/95 |
| 4,751,015 | 6/1988 | Humphreys | 252/99 |
| 4,904,406 | 2/1990 | Darwent | 252/102 |
| 4,978,770 | 12/1990 | Aoyagi | 558/455 |
| 5,078,907 | 1/1992 | Madison et al. | 252/186.39 |
| 5,093,022 | 3/1992 | Sotoya | 252/102 |
| 5,153,348 | 10/1992 | Kerschner | 558/276 |
| 5,236,616 | 8/1993 | Oakes | 252/186.38 |
| 5,360,569 | 11/1994 | Madison | 252/102 |
| 5,413,733 | 5/1995 | Nicholson | 252/186.42 |

FOREIGN PATENT DOCUMENTS

| | | |
|---|---|---|
| 47-20614 | 6/1972 | Japan . |
| 3-287699 | 12/1991 | Japan . |

*Primary Examiner*—Dennis Albrecht
*Attorney, Agent, or Firm*—Wenderoth, Lind & Ponack

[57] ABSTRACT

Proposed is a bleaching composition for house cleaning which exhibits very high bleaching activity but is free from the problem of an unpleasant irritative odor. The composition comprises: (a) a water-soluble peroxide compound such as hydrogen peroxide; and (b) a compound as a bleaching activator represented by the general formula

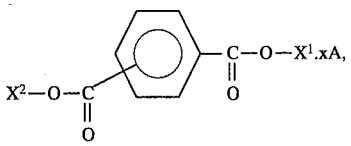

in which $X^1$ is a monovalent group represented by the general formula $R_3N^+—Y—$, each R being, independently from the others, an alkyl group having 1 to 4 carbon atoms and Y being an alkylene group, $X^2$ is a hydrocarbon group, an unsubstituted or N-substituted aminoalkyl group or the same group as $X^1$, A is an anion of n valency and x is a number of 1/n or 2/n so as to balance the positive and negative charges in the molecule.

5 Claims, No Drawings

PEROXIDE BLEACHING COMPOSITIONS CONTAINING QUANTERNARY AMMONIUM PHTHALATE ESTER BLEACH ACTIVATORS FOR HOUSE CLEANING

BACKGROUND OF THE INVENTION

The present invention relates to a novel bleaching composition for house cleaning or, more particularly, to a bleaching composition for house cleaning having excellent bleaching activity but free from the problem due to an unpleasant irritative odor as is unavoidable, for example, in conventional chlorine-generating bleaching compositions.

It is a very troublesome work in daily housekeeping to ensure perfect cleanness in and around various wet and watery places within and around the house where large volumes of water are frequently used such as bathrooms, bathtubs, washstands, water closets, kitchen sinks and the like because the surfaces of the walls there or the sanitary wares used there are heavily stained by organic materials originating in the molds growing on the surface or water-insoluble inorganic materials deposited thereon while it is extremely difficult to completely remove these moldy and water-insoluble stain materials by using a conventional house-cleaning detergent composition containing a surface active agent as the principal ingredient. Accordingly, it is an established way of house cleaning that cleanness of the stained surfaces within and around houses is obtained by using a bleaching composition including chlorine-generating and oxygenic ones so as to completely remove the stain by the bleaching effect thereof.

One of the serious problems in the bleaching compositions comprising a chlorine-generating compound such as sodium hypochlorite as the principal ingredient is that, although such bleaching compositions exhibit an excellent stain-removing effect, they are very detrimental against human body or, in particular, against eyes and skins if not to mention the unpleasant irritative odor of chlorine so that it is essential to use such a chlorine-generating bleaching composition under strong ventilation. In particular, these bleaching compositions have a danger that very toxic chlorine gas is evolved when a chlorine-generating bleaching composition is brought into contact with an acidic detergent.

On the other hand, those bleaching compositions comprising an oxygenic compound typically exemplified by hydrogen peroxide as the principal ingredient are safe from the problem of chlorine gas evolution but their bleaching activity is not always high enough when they are used alone so that various proposals and attempts have been made heretofore for the combined use of an oxygenic bleaching compound with a bleaching activator (see, for example, Japanese Patent Kokai 60-1299, 62-4794, 2-196896 and 3-121200).

Among the bleaching activators proposed heretofore, however, those from which peracetic acid and the like as the active bleaching species are produced emit a strong irritative odor so that they can hardly be used practically for house cleaning. On the other hand, bleaching activators not responsible for the emission of an irritative odor have problems because the stain-removing activity obtained therewith is usually so low or they are so expensive that they are not under wide practical applications for the purpose of house cleaning.

SUMMARY OF THE INVENTION

The present invention accordingly has an object to provide a bleaching composition suitable for house cleaning having high bleaching activity but still free from the problem of emission of an unpleasant irritative odor.

Thus, the bleaching composition for house cleaning provided by the present invention is a mixture comprising:

(a) a water-soluble peroxide compound having bleaching activity; and (b) a compound represented by the general formula

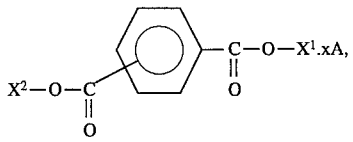

(I)

in which $X^1$ is a monovalent group represented by the general formula $$R_3N^+—Y—, \quad \text{(II)}$$

each R being, independently from the others, an alkyl group having 1 to 4 carbon atoms and Y being an alkylene group, $X^2$ is a hydrocarbon group, an unsubstituted or N-substituted aminoalkyl group or the same group as $X^1$, A is an anion of n valency and x is 1/n when $X^2$ is a hydrocarbon group or unsubstituted or N-mono- or N,N-di-substituted aminoalkyl group or 2/n when $X^2$ is $X^1$ or when $X^2$ is a N,N,N-tri-substituted aminoalkyl group so as to balance the positive and negative charges in the molecule, as a bleaching activator.

The mixing proportion of the component (a) to the component (b) in the bleaching composition is in the range from 30:1 to 1:2 by moles or, preferably, from 20:1 to 1:1 by moles.

DETAILED DESCRIPTION OF THE PREFERRED EMBODIMENTS

As is described above, the bleaching composition of the invention completed as a result of the extensive investigations undertaken by the inventors with the above mentioned object is characterized by the combination of a water-soluble peroxide compound having bleaching activity and a very specific bleaching activator compound of the general formula (I), which is a derivative of a phthalate compound having one or two aminium groups in the molecule.

In the above described bleaching composition for house cleaning, the component (a) is a water-soluble peroxide compound having bleaching activity including hydrogen peroxide and peroxides capable of generating hydrogen peroxide in an aqueous solution. Such a hydrogen peroxide-generating compound is exemplified by alkali metal percarbonates, e.g., sodium percarbonate and potassium percarbonate, alkali metal perborates, e.g., sodium perborate monohydrate and sodium perborate tetrahydrate and alkali metal perphosphates, e.g., sodium tripolyphosphate-hydrogen peroxide adducts and sodium pyrophosphate-hydrogen peroxide adducts, as well as hydrogen peroxide adducts of urea, sodium sulfate, sodium silicate and the like. Particularly preferable as the component (a) are hydrogen peroxide, sodium percarbonate, sodium perborate monohydrate and sodium perborate tetrahydrate. These peroxide compounds can be used either singly or as a combination of two kinds or more according to need.

The component (b) in the inventive bleaching composition serves as a bleaching activator for the above described component (a) as the principal ingredient and is a phthalate derivative represented by the above given general formula (I). In this general formula, $X^1$ is a monovalent group represented by the formula $R_3N^+$—Y—, in which each of the three groups R is, independently from the others, an alkyl group having 1 to 4 carbon atoms including methyl, ethyl, propyl and butyl groups and Y is an alkylene group exemplified by methylene, ethylene, propylene, butylene, pentylene, hexylene, heptylene and octylene groups.

The group denoted by $X^2$ in the general formula (I) is a hydrocarbon group, an unsubstituted or N-substituted aminoalkyl group or the same group as $X^1$ defined above. Examples of the hydrocarbon group include alkyl groups such as methyl, ethyl, propyl and butyl groups, alkenyl groups such as vinyl and allyl groups, aryl groups such as phenyl group, aralkyl groups such as benzyl group and alkaryl groups such as tolyl and xylyl groups. Examples of the unsubstituted or N-alkyl-substituted aminoalkyl group include aminomethyl, dimethylaminoethyl, diethylaminoethyl, dimethylaminopropyl and dimethylaminobutyl groups. When $X^2$ is the same as $X^1$, it is not always necessary that the kinds and combination of the groups denoted by R and Y in $X^2$ are identical with those in $X^1$ per se. The bonding positions of the groups expressed by —CO—O—$X^1$ and —CO—O—$X^2$ in a molecule relative to the benzene ring are not particularly limitative including 1,4-, 1,3- and 1,2-positions.

The symbol A in the general formula (I) denotes an anion of n valency including monovalent anions, i.e. n=1, such as $Cl^-$, $Br^-$, $I^-$, $CH_3SO_4^-$and $CH_3COO^-$ and divalent anions, i.e. n=2, such as $SO_4^{2-}$. The factor x for A is 1/n when $X^2$ is a hydrocarbon group or 2/n when $X^2$ is the same as $X^1$ or when $X^2$ is an unsubstituted or N-substituted alkyl group so as to balance the positive and negative charges in the molecule. Various kinds of the bleaching activator compounds of the general formula (I) can be used either singly or as a combination of two kinds or more according to need.

Examples of the bleaching activator compound as the component (b) include 2-(4-methoxycarbonylbenzoyloxy)-N,N,N-trimethylethane aminium methosulfate, 2-[4-(2-dimethylaminoethoxy) carbonylbenzoyloxy]-N,N,N-trimethylethane aminium methosulfate, benzene-1,4-bis(carbonyloxy-N,N,N-trimethylethane aminium dimethosulfate and the like. These aminium compounds can be used either singly or as a combination of two kinds or more according to need.

The phthalate derivative compound of the general formula (I) can be prepared by a known synthetic method. Following is a description of the synthetic procedure for the preparation of monomethyl monochloline terephthalate, i.e. 2-(4-methoxycarbonylbenzoyloxy)-N,N,N-trimethylethane aminium methosulfate, as a typical example of the compound. Thus, terephthalic acid monomethyl ester monochloride is first reacted with 2-dimethylaminoethyl alcohol to give methyl 2-dimethylaminoethyl terephthalate which is then subjected to a quaternization reaction of the amine by the reaction with dimethyl sulfate to give the desired compound mentioned above. The quaternization reaction of an amine usually cannot be complete so that the reaction product obtained in this way contains an amount of the unquaternized amine compound which is not particularly detrimental against the bleaching activity of the bleaching composition even when the product of the quaternization reaction is compounded as such without purification.

For a further example of the compound of the general formula (I), a method described below is applicable to the synthetic preparation of 2-[4-(2-dimethylaminoethoxy) carbonylbenzoyloxy]-N,N,N-trimethylethane aminium methosulfate. Thus, terephthalic acid dichloride is first reacted with 2-dimethylaminoethyl alcohol to give di-2-dimethylaminoethyl terephthalate which is then subjected to a quaternization reaction of the amine by the reaction with dimethyl sulfate to give the desired compound mentioned above. The quaternization reaction of an amine here also usually cannot be complete so that the reaction product obtained in this way contains an amount of the unquaternized amine compound which is not particularly detrimental against the bleaching activity of the bleaching composition even when the product of the quaternization reaction is compounded as such without purification.

The degree of quarternization naturally depends on the reaction conditions. When the amount of the dimethyl sulfate as the reactant is increased, for example, the yield of the divalent quaternary salt, e.g., benzene-1,4-bis(carbonyloxy-N,N,N-trimethylethane aminium) dimethosulfate, is increased, which, of course, is a compound falling within the definition of the general formula (I) so that the bleaching activity of the composition is not affected thereby.

The quaternization reaction of the amine can be performed also by heating the amine compound with, in place of dimethyl sulfate, methyl acetate to give a quaternized compound in which the methosulfate anion $CH_3SO_4^-$in the above methosulfate compounds is replaced with a carboxyl anion $CH_3COO^-$.

The mixing proportion of the peroxide-based bleaching compound as the component (a) and the above described bleaching activator compound as the component (b) in the inventive bleaching composition is in the range from 30:1 to 1:2 by moles or, preferably, from 20:1 to 1:1 by moles. The bleaching activity of the composition would be decreased when the mixing proportion of the components (a) and (b) does not fall within this range.

It is of course optional according to need that the bleaching composition of the invention for house cleaning described above is admixed with each a limited amount of various kinds of known additives conventionally used in bleaching compositions including, for example, pH controlling agents, surface active agents, water-miscible organic solvents, solubilizing agents, inorganic or organic builders, enzymes, polishing agents, perfumes, pigments, fluorescence brightening agents and the like.

The above mentioned pH controlling agent is used because the bleaching activity of the inventive bleaching composition can be fully exhibited when the aqueous composition has a pH in the range from 6 to 13 or, preferably, from 8 to 12. It is advantageous that the pH controlling agent is admixed with the bleaching composition just before use rather with the composition as prepared for storage in consideration of the influence of the pH value on the stability of the composition.

The pH controlling agent can be an alkaline compound or a buffering agent for alkalinity. Commercially available detergent compositions having alkalinity can be used for the purpose. Examples of the alkaline compound and buffering agent include alkali metal hydroxides such as sodium hydroxide and potassium hydroxide, unsubstituted or N-substituted ammonium compounds such as ammonium hydroxide and mono-, di- and triethanolamines, alkali metal carbonates and hydrogencarbonates such as sodium carbonate, sodium hydrogencarbonate and potassium carbonate, alkali metal silicates such as sodium silicate and potassium silicate, alkali metal phosphate such as sodium tripolyphosphate and sodium pyrophosphate and so on.

It is important in order to obtain full exhibition of the bleaching activity of the inventive bleaching composition that the amount of the above mentioned pH controlling agent should be selected so as to maintain the pH value of the composition throughout the cleaning work in the range from 6 to 13 or, preferably, from 8 to 12 in consideration of the phenomenon that the pH of the composition in the form of an aqueous solution is decreased as a trend along with generation of the bleaching-active species.

Formulation of a surface active agent is desirable in the inventive bleaching composition in order to promote permeation or infiltration of the bleaching-active species into the stain material. Examples of suitable surface active agents include anionic surface active agents such as alkylsulfates, alkylbenzenesulfonates, polyoxyalkylene sulfates, salts of α-sulfofatty acid alcohol esters and salts of sulfosuccinic acid monoesters, non-ionic surface active agents such as polyoxyethylene alkyl ethers, sorbitan fatty acid esters, alkyl glycosides, alkyl glycoside fatty acid esters, polyoxyethylene fatty acid esters, fatty acid glycerides and oxyethylene-oxypropylene block copolymers, cationic surface active agents such as mono- or di(long-chain alkyl) quaternary ammonium salts and amine oxides and amphoteric surface active agents such as carboxybetaines, sulfobetaines and amino acid-based surface active agents.

Examples of the builder, which can be inorganic or organic, as an additive in the inventive bleaching composition include sodium sulfate, sodium silicate, sodium tripolyphosphate, sodium ethylenediamine tetraacetate, sodium nitrilotriacetate, 1-hydroxyethane-1,1-disulfonic acid and other salts. Particularly preferable builders are the chelating builders such as salts of phosphoric acid, salts of polyacrylic acid, salts of polybasic carboxylic acids, zeolites and the like.

Examples of the water-miscible organic solvents which can be contained in the inventive bleaching composition include monohydric alcohols such as methyl alcohol, ethyl alcohol, propanol-2 and propanol-1, dihydric alcohols such as ethyleneglycol, diethyleneglycol, triethyleneglycol, polyethyleneglycol, propyleneglycol, dipropyleneglycol, tripropyleneglycol and polypropyleneglycol and trihydric alcohols such as glycerin as well as mono- and diethers of the above named di- or trihydric alcohol and a monohydric lower alcohol. Urea, p-toluene sulfonic acid and the like have an effect as a solubilizing agent.

Examples of suitable enzymes as an additive in the inventive bleaching composition include hydrolases to promote addition of water to and removal of the stain materials, oxidoreductases to promote oxidizing or reducing reactions, transferases to promote denaturation and removal of the stain materials as a result of transfer of an organic group from one molecule to another, ligases and lyases to promote removal of the stain materials by causing scission of inter- or intramolecular linkages, isomerases to promote chemical denaturation and removal of the stain materials as a result of the isomerization of molecules and so on. Particularly preferable are hydrolases. Proteases as a class of hydrolases are more preferable.

The bleaching composition of the invention for house cleaning can be used inthe form of a solution or, in particular, an aqueous solution containing the components (a) and (b) in a specified proportion as the essential ingredients. Since the storage stability of the inventive bleaching composition in the form of an aqueous solution is decreased when the pH value of the solution is higher than 6, it is preferable that the aqueous solution as prepared has a pH of 6 or lower. This problem is of course of no matter when the component (a) and component (b) are stored in the form of respective aqueous solutions separately in two packages and the contents of the two packages are mixed together directly before use.

As a typical formulation of the inventive bleaching composition for house cleaning, an aqueous solution is prepared by dissolving hydrogen peroxide as the component (a) and benzene-1,4-bis(carbonyloxy-N,N,N-trimethylethane aminium) dimethosulfate as the component (b) to serve as a bleaching activator jointly in water. The concentration of hydrogen peroxide as the component (a) in the aqueous solution is, preferably, in the range from 0.1 to 30% by weight or, more preferably, in the range from 1 to 20% by weight. The concentration of the bleaching activator as the component (b) in the aqueous solution is, preferably, in the range from 0.1 to 30% by weight or, more preferably, in the range from 0.5 to 25% by weight.

It is of course optional that the bleaching composition of the invention is prepared not in the form of a solution but as a solid blend of the components in the form of a cake or powder. When such a solid composition is prepared, it is preferable that the bleaching activator as the component (b) is granulated beforehand prior to blending with the component (a), if necessary, as admixed with a pH controlling agent such as sodium carbonate and potassium carbonate in such an amount that the aqueous solution prepared by dissolving the solid composition in water may have an optimum value of pH. A typical formulation for such a solid preparation of the inventive composition is a combination of sodium percarbonate as the component (a) and 2-(4-methoxycarbonylbenzoyloxy)-N,N,N-trimethylethane aminium methosulfate as the component (b), in which the amount of the component (a) is in the range from 0.1 to 80% by weight or, preferably, from 1 to 60% by weight and the amount of the component (b) is in the range from 0.1 to 60% by weight or, preferably, from 1 to 50% by weight, the balance of the components (a) and (b) being optional ingredients other than water.

In conducting the house-cleaning work by using the inventive bleaching composition, an aqueous solution of the components (a) and (b), which is a mixture of two solutions each containing the component (a) or (b) prepared in advance and stored separately in two packages, is admixed with a pH controlling agent so that the solution may have an optimum value of pH for the bleaching activity and the solution is applied to the stained surface within and around the house. A substantially equivalent bleaching effect can be obtained when the aqueous solutions of the components (a) and (b) are separately applied to the stained surface so as to cause mixing of the solutions in situ on the surface. Although the method for the application of the bleaching solution to a stained surface is not limitative, it is preferable that the solution is sprayed by using a sprayer on to the surface. Alternatively, the bleaching composition can be prepared in the form of a mousse or imparted with an increased viscosity by the admixture of a thickener so that the mousse-like composition or thickened solution is applied by a suitable coating method such as brushing to the stained surface. When one or more of the essential and optional ingredients in the inventive bleaching composition have low solubility in an aqueous medium, the bleaching composition can be prepared in the form of a slurry or paste to be applied to the stained surface.

In the following, examples are given to illustrate the formulation and effectiveness of the bleaching composition of the present invention for house cleaning in more detail but the scope of the present invention is never limited by these examples in any way. In the following description, the term of "parts" for an amount always refers to "parts by weight".

The bleaching compositions prepared in the following examples were evaluated by testing for the stain-removing effect and the mold-removing effect according to the testing procedures and criteria given below.

1. Stain-removing effect

Toilet bowls in a lavatory for male were provided for use in a usual way but without flushing with water during a period of two weeks to accumulate stain on the surface. Thereafter, a 10 ml portion of the sample solution was sprayed on to each of the bowls and, at a moment of 15 minutes thereafter, the bowls were flushed with water. The thus treated toilet bowls were visually inspected by 10 panel members for the organoleptic evaluation of the cleanness to record the results as an average of the values obtained by the 10 panel members in five ratings of criteria giving five points to a perfectly cleaned condition and single point to absolute absence of any cleaning effect, four, three and two points being given to the respective intermediately cleaned conditions.

2. Mold-removing effect

A test specimen, which was a piece of cotton cloth on which a strain of mold *Cladosporium cladosporioides* was cultured to have the mold adhering to the cloth, was dipped in a bath of the sample solution of the bleaching composition and kept there for 15 minutes at 25° C. The test cloth taken out of the sample solution was rinsed with water followed by drying and subjected to the measurement of the color difference in % making reference to the test specimen before the bleaching treatment.

EXAMPLES 1 to 12.

Twelve aqueous bleaching solutions according to the present invention were prepared in Examples 1 to 12 and subjected to the evaluation tests according to the procedures described above. Each of these test solutions contained 3% by weight of hydrogen peroxide as the component (a), 2% by weight of sodium carbonate as the pH controlling agent and 2% by weight of one of the bleaching activator compounds listed below as the component (b). For comparison, a control solution was prepared in the same formulation as above excepting omission of the bleaching activator compound.

Bleaching activator compounds

Example 1

2-(4-methoxycarbonylbenzoyloxy)-N,N,N-trimethylethane aminium methosulfate

Example 2

2-(2-ethoxycarbonylbenzoyloxy)-N,N,N-trimethylethane aminium methosulfate

Example 3

2-[4-(2-dimethylaminoethoxy)carbonylbenzoyloxy]-N,N,N-trimethylethane aminium methosulfate Example 4

2-[3-(2-dimethylaminoethoxy)carbonylbenzoyloxy]-N,N,N-trimethylethane aminium methosulfate Example 5

2-[2-(2-dimethylaminoethoxy)carbonylbenzoyloxyy]-N,N,N-trimethylethane aminium methosulfate Example 6 benzene-1,4-bis(carbonyloxy-N,N,N-trimethylethane aminium) dimethosulfate

Example 7 benzene-1,3-bis(carbonyloxy-N,N,N-trimethylethane aminium) dimethosulfate

Example 8 benzene-1,4-bis(carbonyloxy-N,N,N-trimethylpropane aminium) dimethosulfate

Example 9 benzene-1,4-bis(carbonyloxy-N,N,N-trimethylbutane aminium) dimethosulfate

Example 10 benzene-1,4-bis(carbonyloxy-N,N,-diethyl-N-methylethane aminium) dimethosulfate

Examples 11

2-[4-(2-dimethylaminoethoxy)carbonylbenzoyloxy]-N,N-diisopropyl-N-methylethane aminium methosulfate Example 12

2-[4-(2-dimethylaminoethoxy)carbonylbenzoyloxy]-N,N-dibutyl-N-methylethane aminium methosulfate

TABLE 1

| | Stain-removing effect | Mold-removing effect, % |
|---|---|---|
| Example 1 | 4.7 | 51 |
| Example 2 | 4.6 | 52 |
| Example 3 | 4.8 | 58 |
| Example 4 | 4.7 | 54 |
| Example 5 | 4.6 | 54 |
| Example 6 | 4.8 | 58 |
| Example 7 | 4.7 | 56 |
| Example 8 | 4.5 | 53 |
| Example 9 | 4.3 | 52 |
| Example 10 | 4.5 | 56 |
| Example 11 | 4.4 | 54 |
| Example 12 | 4.4 | 53 |
| Control | 1.8 | 15 |

EXAMPLES 13 to 17.

An aqueous bleaching solution was prepared in each of these examples according to the formulation indicated below to make up an amount of 100 parts and the bleaching solution admixed with a pH controlling agent just before use to have a pH of 10 was applied by spraying to the surface of tiled walls of a bathroom and bathtub covered at least partly with a mold. The results of this cleaning test were that the mold could be completely removed not only from the surface of the tiles but also from the joints between the tiles. Absolutely no irritative odor was felt during the cleaning work.

(Example 13)

| | |
|---|---|
| hydrogen peroxide | 2.5 parts |

-continued

| | |
|---|---|
| benzene-1,4-bis(carbonyloxy-N,N,N-trimethylethane aminium) dimethosulfate | 10.0 parts |
| diethyleneglycol | 10.0 parts |
| water | 77.5 parts |
| (Example 14) | |
| hydrogen peroxide | 5.0 parts |
| benzene-1,4-bis(carbonyloxy-N,N,N-trimethylbutane aminium) dimethosulfate | 10.0 parts |
| polypropyleneglycol | 10.0 parts |
| 1-hydroxyethane-1,1-disulfonic acid | 0.5 part |
| sodium dodecylbenzene sulfonate | 5.0 parts |
| water | 69.5 parts |
| (Example 15) | |
| hydrogen peroxide | 2.5 parts |
| 2-(4-methoxycarbonylbenzoyloxy)-N,N,N-trimethylethane aminium methosulfate | 2.5 parts |
| sodium tripolyphosphate | 5.0 parts |
| polyoxyethylene (12) lauryl ether | 15.0 parts |
| water | 75.0 parts |
| (Example 16) | |
| hydrogen peroxide | 15.0 parts |
| benzene-1,3-bis(carbonyloxy-N,N,N-trimethylbutane aminium) dimethosulfate | 20.0 parts |
| polyoxyethylene (10) lauryl ether | 10.0 parts |
| sodium nitrilotriacetate | 1.0 part |
| sodium salt of methyl α-sulfomyristate | 8.0 parts |
| water | 46.0 parts |
| (Example 17) | |
| hydrogen peroxide | 7.0 parts |
| benzene-1,4-bis(carbonyloxy-N,N,N-trimethylethane aminium) dimethosulfate | 15.0 parts |
| glycerin | 10.0 parts |
| 1-hydroxyethane-1,1-disulfonic acid | 0.5 part |
| cetyl trimethyl ammonium chloride | 4.0 parts |
| lauryl dimethyl amine oxide | 10.0 parts |
| water | 53.5 parts |

EXAMPLES 18 to 22.

A bleaching composition in the form of a powder blend was prepared in each of these examples according to the formulation given below to make up an amount of 100 parts. An aqueous bleaching solution prepared by dissolving the bleaching composition in the form of a powder blend in water in a concentration of 15% by weight was tested for the cleaning work of a moldy bathroom walls in the same manner as in Examples 13 to 17. The results of the test were as satisfactory as in Examples 13 to 17 absolutely without evolution of an irritative odor.

| | |
|---|---|
| (Example 18) | |
| sodium percarbonate | 60 parts |
| benzene-1,4-bis(carbonyloxy-N,N,N-trimethylethane aminium) dimethosulfate | 30 parts |
| sodium carbonate | 10 parts |
| (Example 19) | |
| sodium percarbonate | 40 parts |
| benzene-1,4-bis(carbonyloxy-N,N,N-trimethylbutane aminium) dimethosulfate | 25 parts |
| sodium tripolyphosphate | 10 parts |
| sodium carbonate | 20 parts |
| sodium sulfate | 5 parts |
| (Example 20) | |
| sodium percarbonate | 25 parts |
| 2-(4-methoxycarbonylbenzoyloxy)-N,N,N-trimethylethane aminium) methosulfate | 45 parts |
| sodium nitriloacetate | 10 parts |
| sodium carbonate | 20 parts |
| (Example 21) | |
| sodium perborate monohydrate | 25 parts |
| benzene-1,3-bis(carbonyloxy-N,N,N-trimethylbutane aminium) dimethosulfate | 25 parts |
| zeolite | 10 parts |
| polypropyleneglycol | 10 parts |
| sodium salt of methyl α-sulfomyristate | 10 parts |
| potassium carbonate | 20 parts |
| (Example 22) | |
| sodium perborate tetrahydrate | 50 parts |
| benzene-1,4-bis(carbonyloxy-N,N,N-trimethylethane aminium) dimethosulfate | 30 parts |
| polyoxyethylene (20) lauryl ether | 10 parts |
| sodium carbonate | 10 parts |

What is claimed is:

1. A bleaching composition for house cleaning which comprises, as a mixture:

(a) a water-soluble peroxide compound having bleaching activity; and (b) a compound represented by the general formula

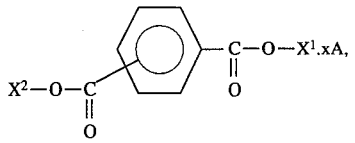

in which $X^1$ and $X^2$ are a monovalent group represented by the general formula $R_3N^+—Y—$, each R being, independently from the others, an alkyl group having 1 to 4 carbon atoms and Y being an alkylene group, A is an anion of n valency and x is a number of 1/n or 2/n so as to balance the positive and negative charges in the molecule, as a bleaching activator, and the proportion of component (a) to component (b) is in the range from 30:1 to 1:2 on a molar basis.

2. The bleaching composition for house cleaning as claimed in claim 1 in which the water-soluble peroxide compound as the component (a) is hydrogen peroxide or a peroxide capable of generating hydrogen peroxide in an aqueous solution.

3. The bleaching composition for house cleaning as claimed in claim 1 in which the peroxide capable of generating hydrogen peroxide in an aqueous solution is an alkali metal percarbonate or an alkali metal perborate.

4. The bleaching composition for house cleaning as claimed in claim 1 which further comprises a pH controlling agent in such an amount that an aqueous solution of the composition has a pH in the range from 6 to 13.

5. The bleaching composition for house cleaning as claimed in claim 4 in which the pH controlling agent is selected from the group consisting of alkali metal hydroxides, ammonium hydroxide, alkali metal carbonates, alkali metal silicates, alkali metal phosphates and mono-, di- and trierhanol amines.

* * * * *